US011353243B1

(12) United States Patent
Hutchison et al.

(10) Patent No.: US 11,353,243 B1
(45) Date of Patent: Jun. 7, 2022

(54) GAS FUELED WATER HEATER APPLIANCE HAVING ONE OR MORE BURNER MOUNTING FEATURES

(71) Applicant: Haier US Appliance Solutions, Inc., Wilmington, DE (US)

(72) Inventors: Gregory L. Hutchison, Shelbyville, KY (US); Gary Allen Elder, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/116,219

(22) Filed: Dec. 9, 2020

(51) Int. Cl.

| | |
|---|---|
| ***F23C 5/02*** | (2006.01) |
| ***F24H 9/1836*** | (2022.01) |
| ***F24H 1/00*** | (2022.01) |

(52) U.S. Cl.
CPC ..... *F24H 9/1836* (2013.01); *F23C 5/02* (2013.01); *F24H 1/0027* (2013.01); *F23C 2700/04* (2013.01)

(58) Field of Classification Search
CPC ..... F23C 5/02; F23C 5/06; F23R 3/60; F23N 2900/05005
See application file for complete search history.

(56) References Cited

U.S. PATENT DOCUMENTS

| | | | | |
|---|---|---|---|---|
| 4,829,983 | A * | 5/1989 | West | F23C 5/02 122/17.1 |
| 6,945,196 | B1 * | 9/2005 | Hubert | F23C 5/02 122/14.2 |
| 7,665,426 | B2 * | 2/2010 | O'Donnell | F23C 5/02 122/17.1 |
| 7,946,257 | B2 * | 5/2011 | Hicks | F23L 1/00 122/17.1 |
| 2004/0094099 | A1 | 5/2004 | Carbone et al. | |
| 2013/0059257 | A1 * | 3/2013 | Cook et al. | |

FOREIGN PATENT DOCUMENTS

| | | | |
|---|---|---|---|
| CN | 201748653 | U | 2/2011 |
| CN | 110617616 | A | 12/2019 |
| DE | 102004062185 | * | 7/2006 |

* cited by examiner

*Primary Examiner* — Gregory A Wilson
(74) *Attorney, Agent, or Firm* — Dority & Manning, P.A.

(57) ABSTRACT

A gas fueled water heater appliance may include a tank for storage of water, a chamber wall, a gas burner, a gas conduit, a support post, and a guide bracket. The chamber wall may define a combustion chamber and a conduit hole. The gas burner may be positioned adjacent to the tank and within the combustion chamber. The gas conduit may extend from the gas burner and through the conduit hole. The support post may be fixed to the gas burner within the combustion chamber. The guide bracket may be mounted within the combustion chamber and define a mounting point. The guide bracket may be in selective engagement with the support post at the mounting point. The guide bracket may include a pair of lateral arms extending outward from the mounting point toward the chamber wall to guide the support post to the mounting point.

20 Claims, 9 Drawing Sheets

GAS FUELED WATER HEATER APPLIANCE HAVING ONE OR MORE BURNER MOUNTING FEATURES

FIELD OF THE INVENTION

The present subject matter relates generally to gas fueled water heater appliances, and more particularly to gas fueled water heater appliances having features for mounting or restraining the burner within an appliance.

BACKGROUND OF THE INVENTION

A variety of energy sources are used in creating hot water for commercial and residential use including electric, solar, and various fuels. Natural gas and propane are preferred by some customers due to, for example, the relatively quick heating rate. These fuels are supplied as a gas that is burned in a combustion chamber to provide heat energy to raise the water temperature (e.g., within a water tank above the combustion chamber).

In particular, a burner is typically provided within the combustion chamber to burn the supplied gas and direct heat to the water tank. Generally, the burner must be disposed at a specific predetermined location within the combustion chamber. If the burner is not assembled or maintained at the predetermined location, performance can suffer. Moreover, if the burner is not secured or held in the predetermined location, it is possible that the burner (or hot water heater appliance in general) may become damaged, such as during shipment or installation. As a result, it is generally important to install and maintain the burner in the predetermined location within the appliance.

Nonetheless, it may be difficult to secure the gas burner in the predetermined location within the combustion chamber (e.g., due to the relatively small size of the combustion chamber and need to ensure a strong seal about the combustion chamber). At times, it may be hard for an assembly worker to even confirm that the burner has been appropriately mounted within the combustion chamber. Such difficulties with can add to the time or expense for the assembly process. Moreover, they may create inconsistencies in performance or durability of the assembled appliance.

As a result, it would be useful to provide a hot water heater appliance having features for addressing one or more of the above issues. For instance, it may be advantageous to provide a hot water heater appliance with features for guiding a gas burner to an appropriate mounting location during installation. Additionally or alternatively, it may be advantageous to provide a hot water heater appliance with features for securing a gas burner at a predetermined location within a combustion chamber.

BRIEF DESCRIPTION OF THE INVENTION

Aspects and advantages of the invention will be set forth in part in the following description, or may be obvious from the description, or may be learned through practice of the invention.

In one aspect of the present disclosure, a gas fueled water heater appliance is provided. The gas fueled water heater appliance may include a tank for storage of water for heating, a chamber wall, a gas burner, a gas conduit, a support post, and a guide bracket. The chamber wall may define a combustion chamber and a conduit hole permitting access thereto. The gas burner may be positioned adjacent to the tank and within the combustion chamber to heat the water in the tank. The gas conduit may extend from the gas burner and through the conduit hole. The support post may be fixed to the gas burner within the combustion chamber. The guide bracket may be mounted within the combustion chamber and define a mounting point. The guide bracket may be in selective engagement with the support post at the mounting point. The guide bracket may include a pair of lateral arms extending outward from the mounting point toward the chamber wall to guide the support post to the mounting point.

In another aspect of the present disclosure, a gas fueled water heater appliance is provided. The gas fueled water heater appliance may include a tank for storage of water for heating, a bottom wall, a chamber wall, a gas burner, a gas conduit, a support post, and a guide bracket. The bottom wall may extend below the tank. The chamber wall may define a combustion chamber and a conduit hole permitting access thereto. The gas burner may be positioned adjacent to the tank and within the combustion chamber to heat the water in the tank. The gas conduit may extend from the gas burner and through the conduit hole. The support post may be fixed to the gas burner within the combustion chamber. The guide bracket may be mounted within the combustion chamber and define a mounting point at an inner edge. The guide bracket may be in selective engagement with the support post at the mounting point. The guide bracket may include a pair of lateral arms extending outward from the mounting point toward the chamber wall to a pair of corresponding outer tips in order to guide the support post to the mounting point. The outer tips may be disposed proximal to the conduit hole relative to the inner edge.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
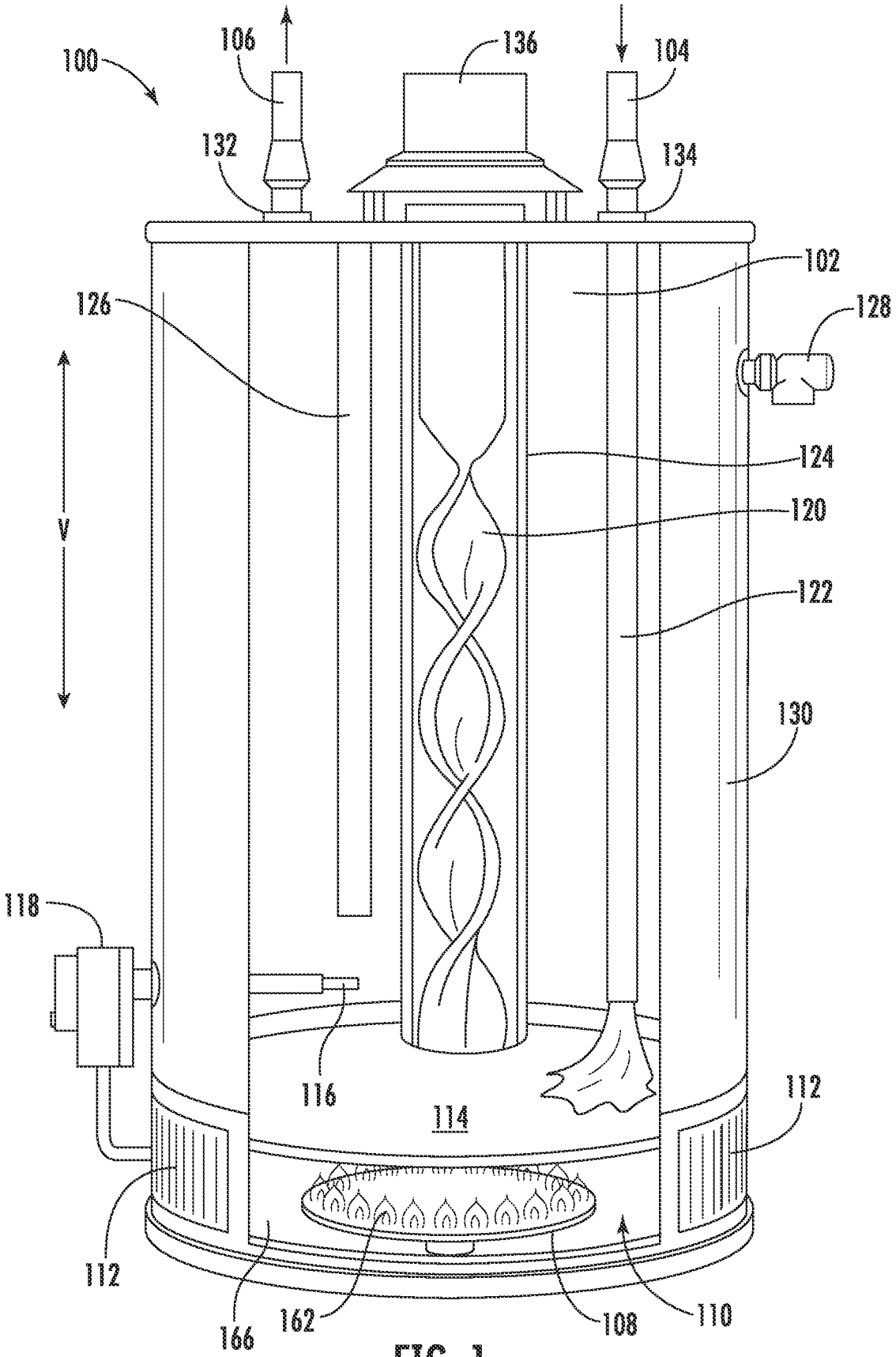
FIG. 1 provides a partially cut away, perspective view of a water heater appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components.

Figure 2:
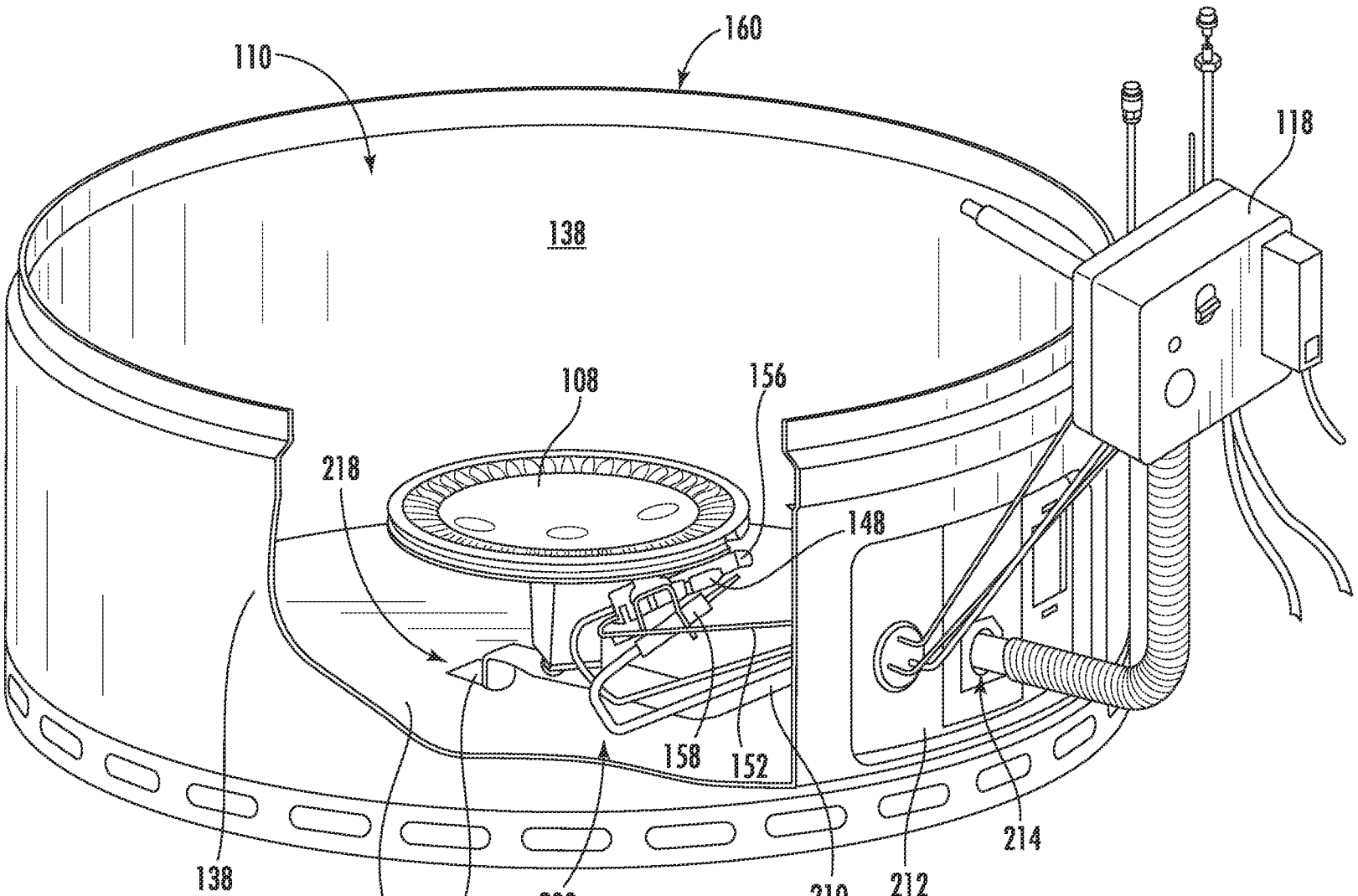
FIG. 2 provides a perspective view of an exemplary gas combustion chamber, wherein a mounting bracket has been removed for clarity, as may be used with the exemplary water heater appliance of FIG. 1.
Figure 3:
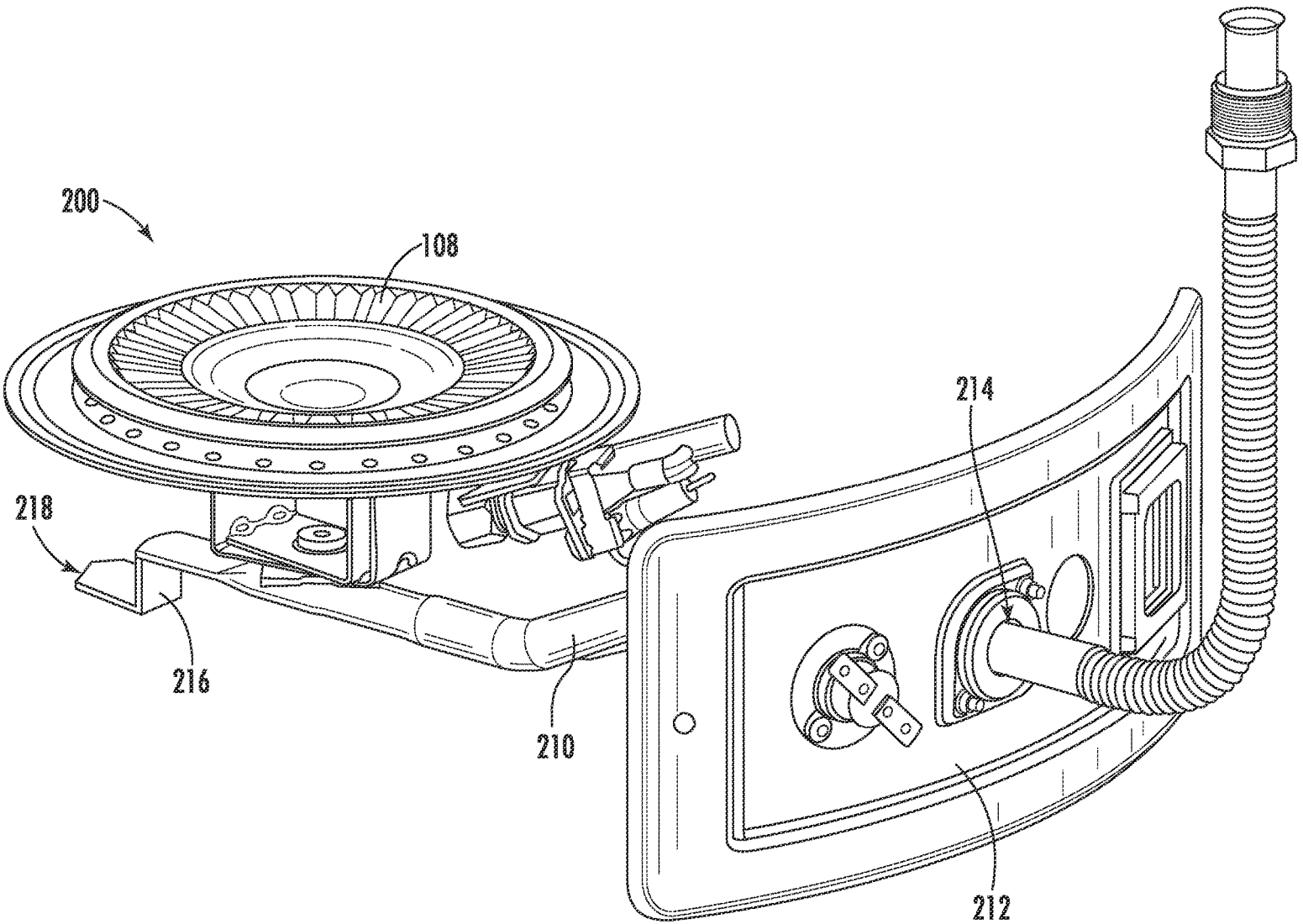
FIG. 3 provides a perspective view of a burner assembly, in isolation, of the exemplary water heater appliance of FIG. 1.
Figure 4:
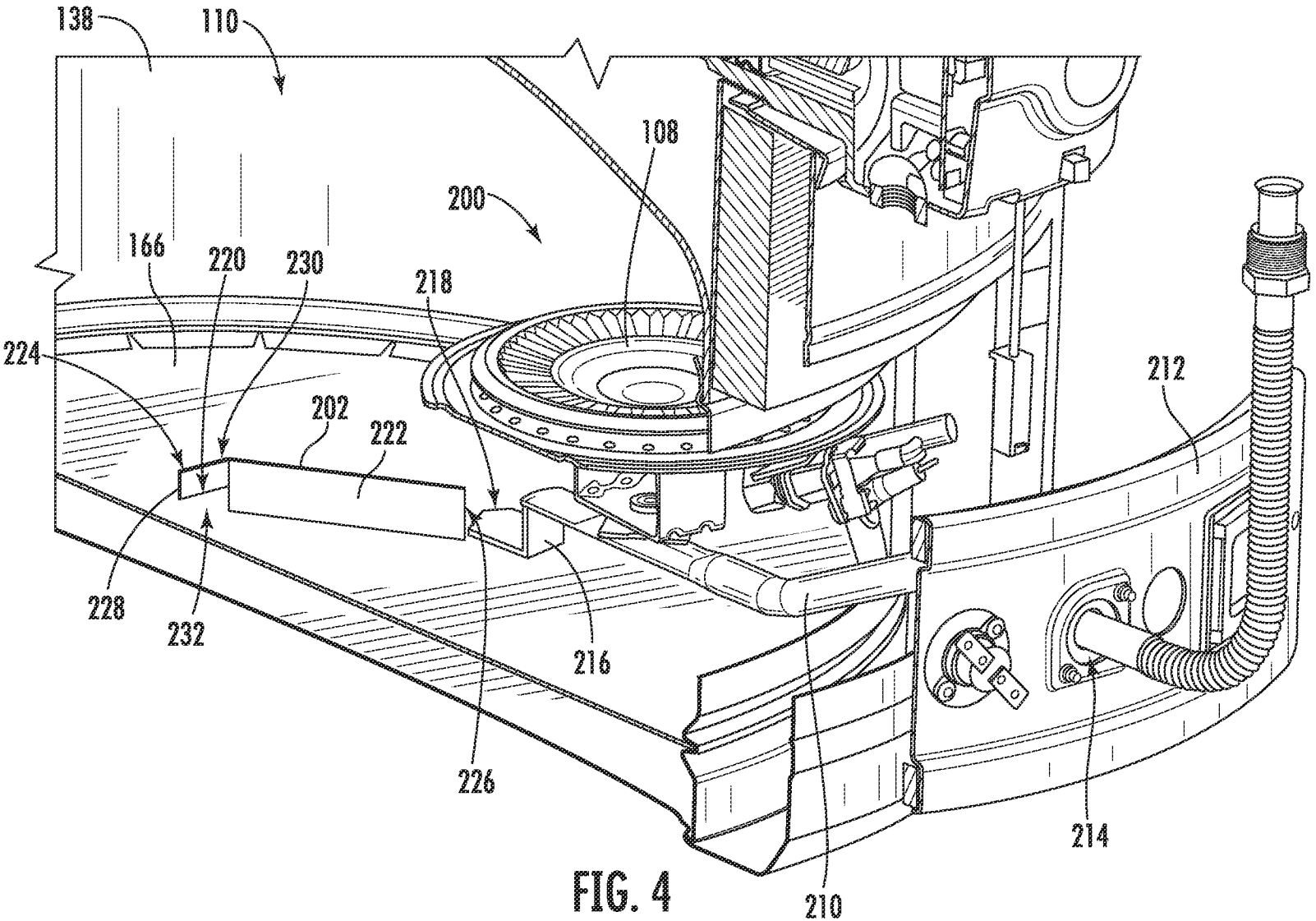
FIG. 4 provides a cross-sectional perspective view of an exemplary combustion chamber according to exemplary embodiments of the present disclosure during a portion of the assembly process.

Referring now to the figures, FIG. 1 illustrates a partial sectional, side perspective view of an exemplary water heater 100 of the present disclosure. FIG. 2 provides a provides a perspective view of a portion of water heater 100, including a burner assembly 200 and a portion of a gas combustion chamber 110. FIG. 3 provides a perspective view of burner assembly 200 in isolation.

As shown, water heater 100 includes a tank 102 where water is stored and heated. Water is supplied to tank 102 by inlet line 104. Heated water is supplied by tank 102 through outlet line 106. Water heater 100 is fluidly connected with lines 104 and 106 using connections 132 and 134. In turn, lines 104 and 106 connect with the water supply system of, for example, a residence or a commercial structure.

From line 104, water travels into tank 102 through a cold water dip tube 122 that extends along vertical direction V towards the bottom 114 of tank 102. After being heated, water exits tank 102 by travelling vertically upward and out through outlet line 106. Anode rod 126 provides protection against corrosion attacks on tank 102 and other metal components of water heater 100. A pressure relief valve 128 provides for a release of water from tank 102 in the event the pressure rises above a predetermined amount.

Water heater 100 includes a combustion chamber 110 in which a gas burner 108 of a burner assembly 200 is centrally located. During use, gas burner 108 may be supplied with a gaseous fuel (e.g., propane or natural gas) through one or more conduits, such as a chamber gas conduit 210 disposed within the combustion chamber 110. Air travels into combustion chamber 110 through air intake 112 in cabinet 130. The resulting mixture of air and gas is ignited and burned to heat bottom 114 of tank 102 and its water contents. Hot combustion gas exits combustion chamber 110 through a vent or flue 124 centrally located within tank 102. Heat exchange with flue 124 may help heat water in tank 102. A baffle 120 may further promote this heat exchange. Gas exits water heater 100 though vent hood 136, which may be connected with additional vent piping (not shown).

A thermostat 116 measures the temperature of water in tank 102 and provides a signal to gas control valve module 118. As used herein, "a signal" is not limited to a single measurement of temperature and, instead, may include multiple measurements over time or continuous measurements over time. The signal may be provided through, for example, changes in current, voltage, resistance, or others. Depending upon whether the desired temperature has been reached as determined (e.g., from the signal from thermostat 116), gas control valve module 118 regulates the flow of gas to burner 108.

Generally, combustion chamber 110 is formed by a chamber wall 138 that at least partially encloses combustion chamber 110 and may also provide support for tank 102 along top edge 160. In some such embodiments, a bottom wall 166 extends below combustion chamber 110 (e.g., to define a lowermost section or extreme of combustion chamber 110).

As shown, chamber wall 138 encircles burner 108 and is spaced apart (e.g., radially) from burner 108. Moreover, chamber wall 138 may be formed from one or more panels. At least one panel (e.g., assembly panel 212) may define a conduit hole 214 through which chamber gas conduit 210 may be disposed. Chamber wall 138 may be part of cabinet 130 (FIG. 1) or may be a separate component.

As shown, water heater 100 includes a pilot burner 148 that provides a pilot light to ignite a mixture of air and fuel at burner 108 when a gas valve is open. An igniter 158 is positioned adjacent to pilot burner 148 and generates a spark used to ignite gaseous fuel and provide pilot light. Gaseous fuel for pilot burner 108 is supplied by pilot burner fuel line 152. Gas valve control module 118 with controller controls the flow of gaseous fuel through pilot burner fuel line 152 and the flow of gas to burner 108 from gaseous fuel supply.

Gas valve control module 118 includes at least one controller. By way of example, controller may include memory (e.g., non-transitive storage media) and one or more processing devices such as microprocessors, CPUs or the like, such as general or special purpose microprocessors operable to execute programming instructions or micro-control code associated with operation of water heater 100 as further described herein. The memory can represent random access memory such as DRAM, or read only memory such as ROM or FLASH. The processor executes programming instructions stored in the memory. The memory can be a separate component from the processor or can be included onboard within the processor. Alternatively, controller may be constructed without using a microprocessor, for example, using a combination of discrete analog and/or digital logic circuitry (such as switches, amplifiers, integrators, comparators, flip-flops, AND gates, and the like) to perform control functionality instead of relying upon software.

As stated above, water heater 100 includes a gas valve positioned along main gas supply line. Controller is in operable communication (e.g., electrically connected, wirelessly connected, etc.) with gas valve to generally control the flow of gas therethrough by determining when valve is energized. In some embodiments, gas valve operates so that when energized, valve is fully open to allow a flow of gaseous fuel to burner 108. When not fully energized, valve is fully closed (i.e., a "fail-closed" type valve) so as to prevent the flow of gaseous fuel to burner 108.

Figure 5:
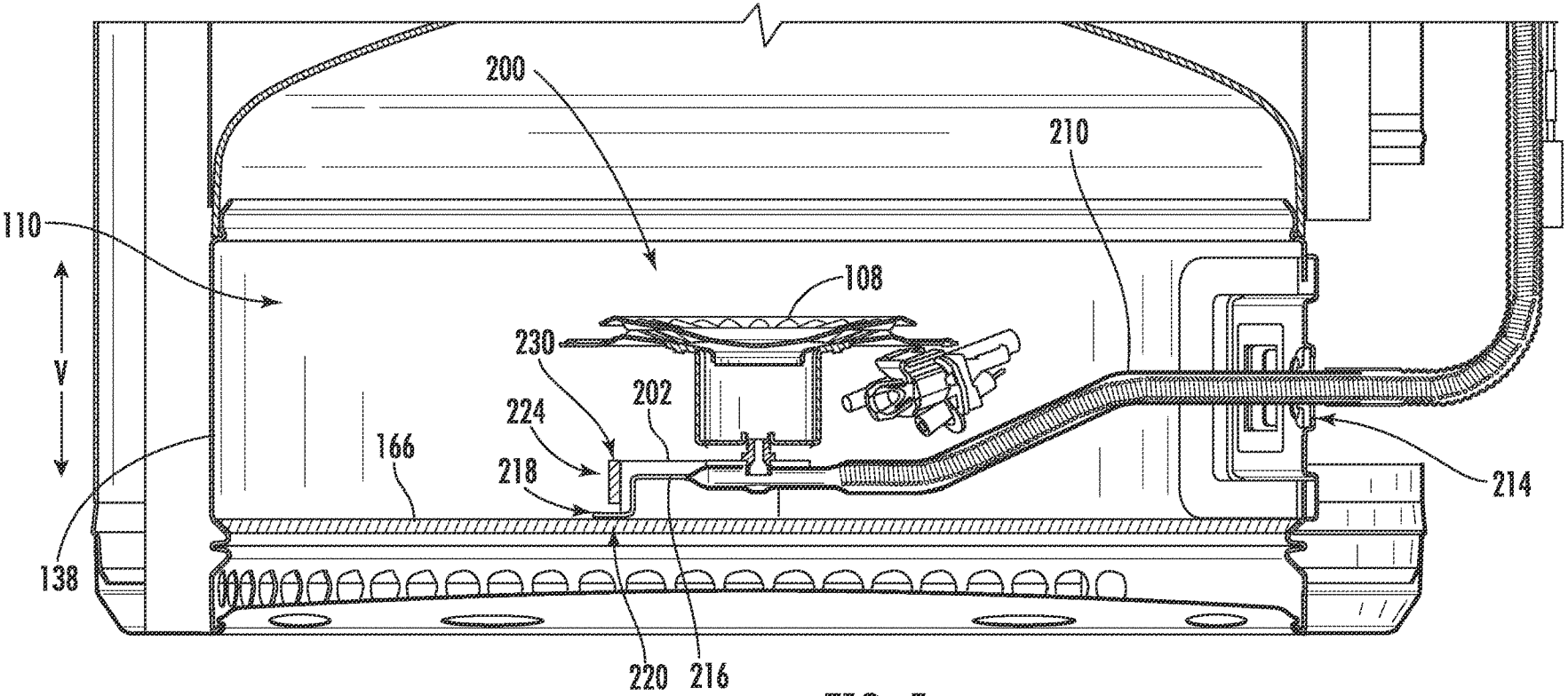
FIG. 5 provides a side section view of the exemplary combustion chamber of the exemplary water heater appliance of FIG. 4 in an assembled state.
Figure 6:
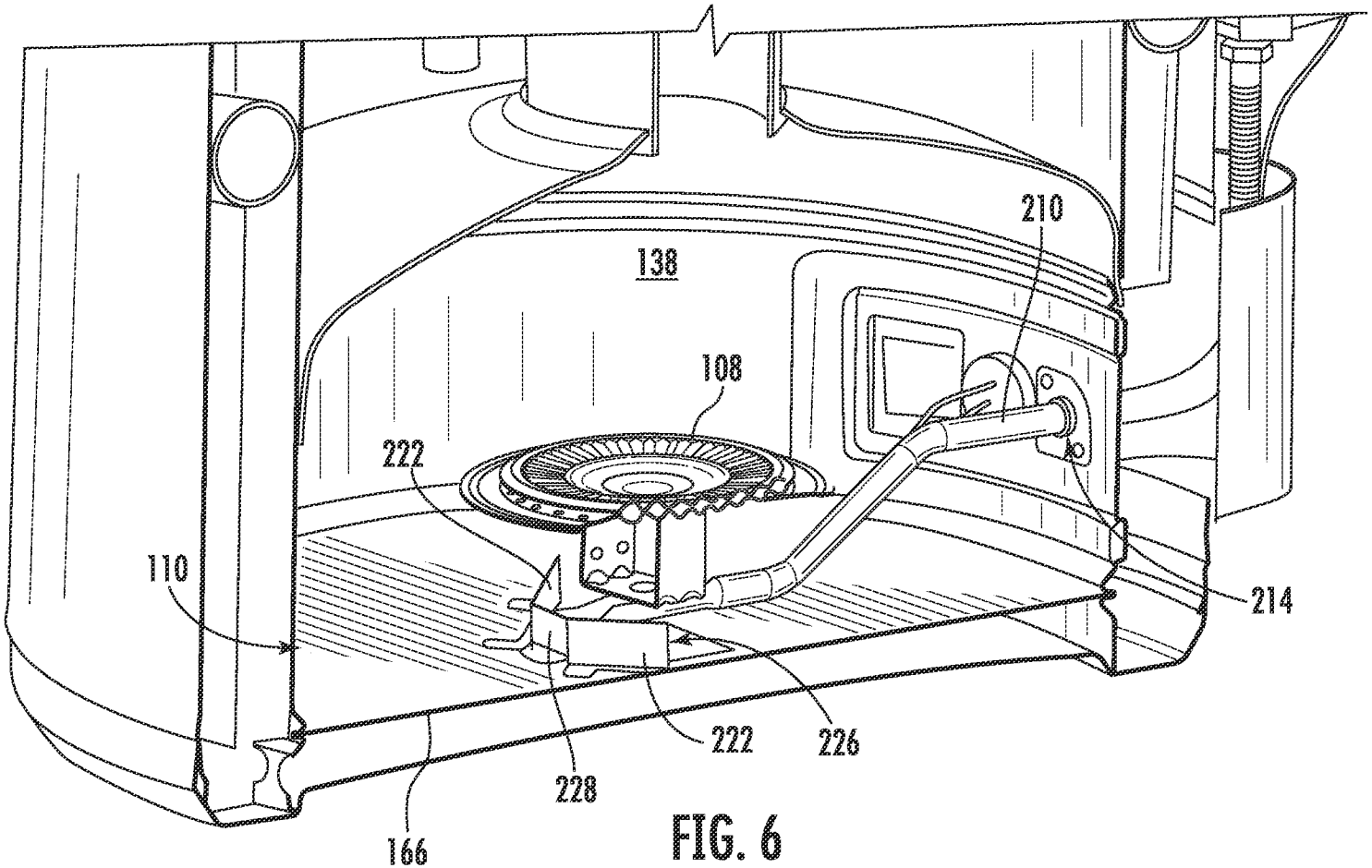
FIG. 6 provides a cross-sectional perspective view of the exemplary combustion chamber of the exemplary water heater appliance of FIG. 4 in an assembled state.
Figure 7:
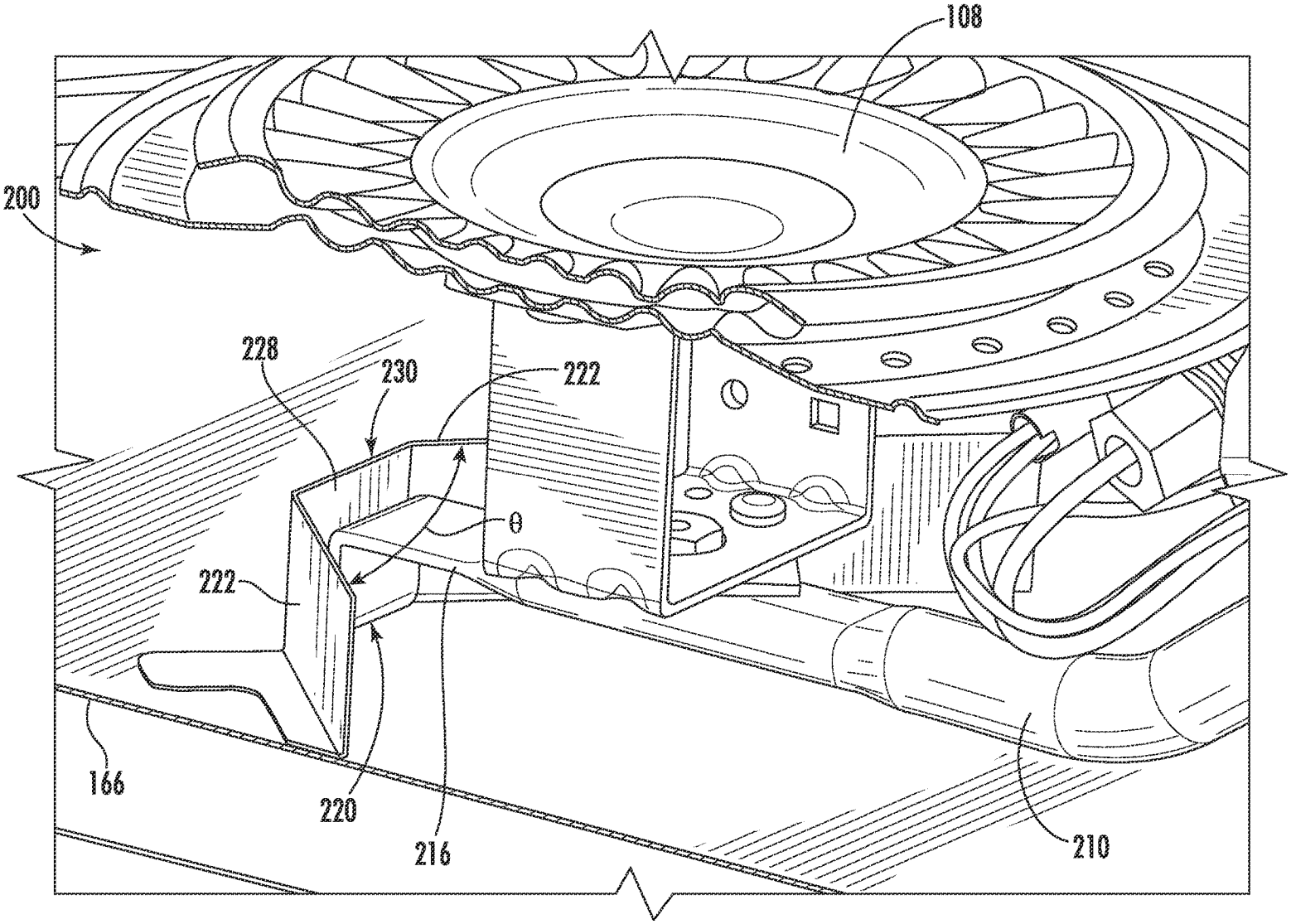
FIG. 7 provides a magnified cross-sectional perspective view of the exemplary combustion chamber of the exemplary water heater appliance of FIG. 4 in an assembled state.

Turning now to FIGS. 3 through 7, various views are provided of burner assembly 200, either in isolation (FIG. 3), during an assembly step that includes gas burner 108 being inserted to combustion chamber 110 (FIG. 4), or in an assembled state within combustion chamber 110 (FIGS. 5, 6, and 7).

In some embodiments, gas burner 108 may be supported on gas conduit 210. During the assembly process, gas burner 108 may thus be moved (e.g., radially) into combustion chamber 110 with gas conduit 210. Assembly panel 212 defining the conduit hole 214 within which gas conduit 210 is disposed may further be moved together with gas burner 108 and gas conduit 210.

In certain embodiments, a support post 216 is fixed to gas burner 108 within the combustion chamber 110. For instance, support post 216 may attach to gas conduit 210 and, thus, move together with gas burner 108 (e.g., during assembly or installation). Support post 216 may be attached to gas conduit 210 (e.g., as a discrete component or, alternatively, as an integral unitary element). Optionally, support post 216 may be disposed opposite of the conduit hole 214. In some such embodiments, gas conduit 210 extends radially between conduit hole 214 and support post 216. As shown, support post 216 may define a free tip 218 at a radial extreme of gas conduit 210. Additionally or alternatively, support post 216 may include a Z-bend segment that descends from one upper section (e.g., disposed against gas conduit 210) to a lower section (e.g., extending to free tip 218), which is generally illustrated in FIGS. 3 through 7.

Within combustion chamber 110, a guide bracket 202 may be mounted to engage burner assembly 200 and, in turn, secure gas burner 108 to a predetermined location within combustion chamber 110. As shown, guide bracket 202 defines a mounting point 220 and includes a pair of lateral arms 222 that extend outward from mounting point 220. Generally, guide bracket 202 may be fixed within combustion chamber 110. For instance, guide bracket 202 may be secured to bottom wall 166 (e.g., via one or more mechanical fasters or welds). As burner assembly 200 is moved radially into (or relative to) combustion chamber 110, guide bracket 202 may thus remain stationary.

As shown, guide bracket 202 defines a mounting point 220 at which guide bracket 202 can selectively engage burner assembly 200. Specifically, guide bracket 202 may engage or receive at least a portion of support post 216 at mounting point 220. For instance, at mounting point 220, guide bracket 202 may restrict or otherwise limit radial or horizontal movement of burner assembly 200. In some such embodiments, as burner assembly 200 is being inserted further into combustion chamber 110, support post 216 contacts guide bracket 202, which in turn stops further radial advancement of burner assembly 200.

Fanning outward from mounting point 220, the pair of lateral arms 222 may each be disposed at opposite sides of mounting point 220. In particular, the pair of lateral arms 222 extend outward from the mounting point 220 toward the chamber wall 138 to guide the support post 216 to the mounting point 220. In some such embodiments, guide bracket 202 defines an outer edge (e.g., a pair of outer tips 226) to which the lateral arms 222 extend and an inner edge 224 at which the mounting point 220 is defined. Inner edge 224 may be disposed at or proximal to the center of combustion chamber 110 while the outer tips 226 are distal to the center (e.g., in comparison to inner edge 224).

As shown, a funnel or wedge gap may be defined between the lateral arms 222. Thus, the angle from one lateral arm 222 to the other lateral arm 222 may be less than 180°. In optional embodiments, an obtuse angle θ that is less than 180° is defined between the pair of lateral arms 222. Thus, the funnel or wedge gap defined by the lateral arms 222 may be greater than 90° and less than 180°. In additional or alternative embodiments, the funnel or wedge gap may be radially aligned with conduit hole 214. The outer tips 226 may be defined at opposite of sides of conduit hole 214. Moreover, the outer tips 226 may be disposed proximal to conduit hole 214 in comparison to inner edge 224. Thus, the outer tips 226 may be closer to conduit hole 214 than inner edge 224 and mounting point 220.

Advantageously, assembly of burner assembly 200 within combustion chamber 110 may be improved such that an operator or assemblyperson may easily guide support post 216 to mounting point 220 after ensuring support post 216 is between the lateral arms 222. Even if support post 216 is not initially aligned with mounting point 220, contact with either lateral arm 222 as the support post 216 moves radially inward may direct support post 216 to mounting point 220.

In the illustrated embodiments of FIGS. 3 through 7, guide bracket 202 includes a center wall 228 from which the lateral arms 222 extend. Specifically, center wall 228 defines mounting point 220. Thus, the lateral arms 222 may extend from opposite sides of center wall 228. Moreover, in the assembled state, support post 216 may contact center wall 228.

As shown, center wall 228 may extend upward from bottom wall 166 to a top edge 230. Mounting point 220 may be defined below top edge 230. In some embodiments, mounting point 220 is provided at a holding slot 232 defined by guide bracket 202 (e.g., at center wall 228). Holding slot 232 may generally be sized and shaped to receive the free tip 218 of support post 216. Moreover, holding slot 232 may be defined at a lower vertical height than burner 108. Optionally, holding slot 232 may be defined between guide bracket 202 and bottom wall 166 (e.g., an upper surface thereof) along the vertical direction V. Thus, in the assembled state, support post 216 may be vertically constrained between top edge 230 and bottom wall 166 while being laterally constrained between the pair of lateral arms 222.

Figure 8:
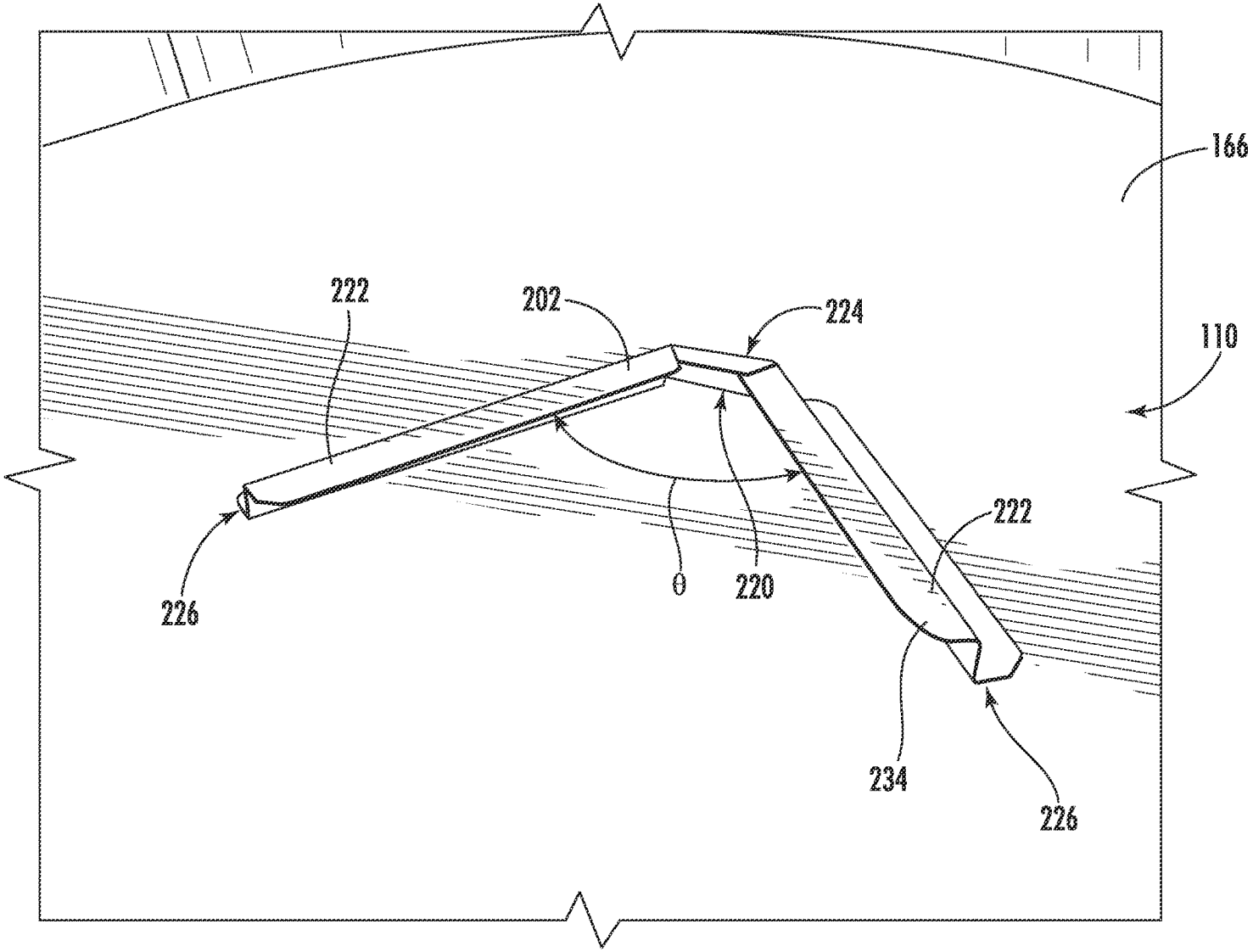
FIG. 8 provides a perspective view of a guide bracket within a combustion chamber as may be used with the exemplary water heater appliance of FIG. 1.

Generally, guide bracket 202 may be formed from a suitable rigid material, such as a sheet metal steel. Turning briefly to FIG. 8, in optional embodiments, guide bracket 202 further includes a forward top lip 234. Generally, forward top lip 234 extends horizontally forward (e.g., toward the funnel or conduit hole 214) at the top edge of center wall 228 or lateral arms 222. Thus, forward top lip 234 may provide a rim that can vertically restrain support post 216 during assembly (e.g., before support post 216 is disposed at mounting point 220).

Figure 9:
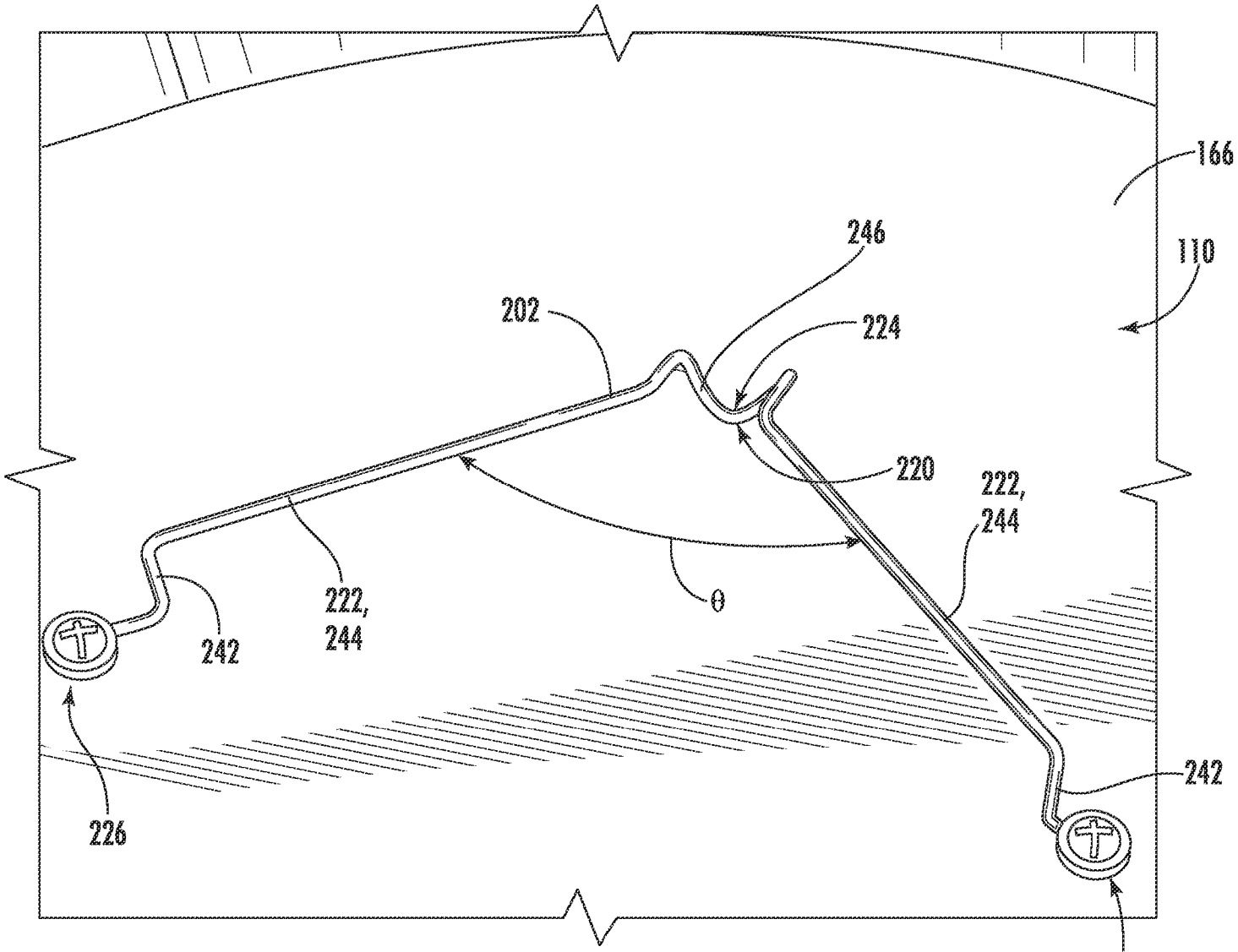
FIG. 9 provides a perspective view of another guide bracket within a combustion chamber as may be used with the exemplary water heater appliance of FIG. 1.

Turning now to FIG. 9, in further embodiments, guide bracket 202 includes or is formed from a spring bent metal body that is biased downwards (e.g., toward bottom wall 166) at mounting point 220. As shown, guide bracket 202 may be anchored to bottom wall 166 at the outer tips 226 (e.g., by separate mechanical fasteners). At the outer tips 226, each lateral arm 222 may further include a L-tab 242 that extends upwards from the corresponding lateral tip to a primary rail 244 of the lateral arm 222. Thus, the primary rail 244 of each lateral arm 222 may be spaced apart from (e.g., above) bottom wall 166. At mounting point 220, guide bracket 202 may include a contact nose 246 that descends downwards from and between the primary rails 244. Prior to insertion of support post 216 (FIG. 3) contact nose 246 may thus be biased against bottom wall 166. During installation, support post 216 may slide below or beneath the primary rails 244 (e.g., along bottom wall 166) until the contact nose 246 is reached. At the contact nose 246, the support post 216 may force the guide bracket 202 upward such that support post 216 is pinned between contact nose 246 and bottom wall 166.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A gas fueled water heater appliance, comprising:
- a tank for storage of water for heating;
- a chamber wall defining a combustion chamber and a conduit hole permitting access thereto;
- a gas burner positioned adjacent to the tank and within the combustion chamber to heat the water in the tank;
- a gas conduit extending from the gas burner and through the conduit hole;
- a support post fixed to the gas burner within the combustion chamber; and
- a guide bracket mounted within the combustion chamber and defining a mounting point, the guide bracket being in selective engagement with the support post at the mounting point, the guide bracket comprising a pair of lateral arms extending outward from the mounting point toward the chamber wall to guide the support post to the mounting point,
- wherein the support post is fixed to the gas conduit and comprises a Z-bend segment within the combustion chamber, the Z-bend segment descending from the gas burner to the mounting point.

2. The gas fueled water heater appliance of claim 1, further comprising a bottom wall extending below the combustion chamber, wherein the guide bracket is mounted to the bottom wall.

3. The gas fueled water heater appliance of claim 2, wherein the guide bracket comprises a planar center wall from which the pair of lateral arms extend.

4. The gas fueled water heater appliance of claim 1, wherein an obtuse angle less than 180° is defined between the pair of lateral arms.

5. The gas fueled water heater appliance of claim 1, wherein the guide bracket defines an inner edge at the mounting point and a pair of outer tips at the pair of lateral arms, and wherein the outer tips are disposed proximal to the conduit hole relative to the inner edge.

6. The gas fueled water heater appliance of claim 1, wherein the guide bracket defines a holding slot below a top edge of the bracket.

7. The gas fueled water heater appliance of claim 6, further comprising a bottom wall extending below the combustion chamber to define a lowermost section of the combustion chamber, wherein the holding slot is defined between the bottom wall and the guide bracket along a vertical direction.

8. The gas fueled water heater appliance of claim 1, wherein the guide bracket comprises a forward top lip extending toward the conduit hole at a top edge of the guide bracket.

9. The gas fueled water heater appliance of claim 1, wherein the guide bracket comprises a spring bent metal body biased downwards at the mounting point.

10. A gas fueled water heater appliance, comprising:
- a tank for storage of water for heating;
- a bottom wall extending below the tank;
- a chamber wall defining a combustion chamber between the tank and the bottom wall, the chamber wall further defining a conduit hole permitting access thereto;
- a gas burner positioned adjacent to the tank and within the combustion chamber to heat the water in the tank;
- a gas conduit extending from the gas burner and through the conduit hole;
- a support post fixed to the gas burner within the combustion chamber; and
- a guide bracket mounted to the bottom wall and defining a mounting point at an inner edge, the guide bracket being in selective engagement with the support post at the mounting point, the guide bracket comprising a pair of lateral arms extending outward from the mounting point toward the chamber wall to a pair of corresponding outer tips in order to guide the support post to the mounting point, the outer tips being disposed proximal to the conduit hole relative to the inner edge,
- wherein the support post is fixed to the gas conduit and comprises a Z-bend segment within the combustion chamber, the Z-bend segment descending from the gas burner to the mounting point.

11. The gas fueled water heater appliance of claim 10, wherein the guide bracket comprises a planar center wall from which the pair of lateral arms extend.

12. The gas fueled water heater appliance of claim 10, wherein an obtuse angle less than 180° is defined between the pair of lateral arms.

13. The gas fueled water heater appliance of claim 10, wherein the guide bracket defines a holding slot below a top edge of the bracket.

14. The gas fueled water heater appliance of claim 10, wherein the guide bracket comprises a forward top lip extending toward the conduit hole at a top edge of the guide bracket.

15. The gas fueled water heater appliance of claim 10, wherein the guide bracket comprises a spring bent metal body biased downwards at the mounting point.

16. A gas fueled water heater appliance, comprising:
- a tank for storage of water for heating;
- a chamber wall defining a combustion chamber and a conduit hole permitting access thereto;
- a gas burner positioned adjacent to the tank and within the combustion chamber to heat the water in the tank;
- a gas conduit extending from the gas burner and through the conduit hole;
- a support post fixed to the gas burner within the combustion chamber; and
- a guide bracket mounted within the combustion chamber and defining a mounting point, the guide bracket being in selective engagement with the support post at the mounting point, the guide bracket comprising a pair of lateral arms extending outward from the mounting point toward the chamber wall to guide the support post to the mounting point,
- wherein the guide bracket comprises a spring bent metal body biased downwards at the mounting point.

17. The gas fueled water heater appliance of claim 16, further comprising a bottom wall extending below the combustion chamber, wherein the guide bracket is mounted to the bottom wall.

18. The gas fueled water heater appliance of claim 17, wherein each lateral arm comprises a primary rail that is vertically spaced apart from the bottom wall.

19. The gas fueled water heater appliance of claim 16, wherein an obtuse angle less than 180° is defined between the pair of lateral arms.

20. The gas fueled water heater appliance of claim 16, wherein the guide bracket comprises a contact nose that descends downwards at the mounting point from the pair of lateral arms.

* * * * *